US007214170B2

(12) United States Patent
Sumners et al.

(10) Patent No.: US 7,214,170 B2
(45) Date of Patent: May 8, 2007

(54) VIBRATIONARY EXERCISE APPARATUS

(75) Inventors: David Paul Sumners, Middlesbrough (GB); Roger Leslie Brown, London (GB)

(73) Assignee: South Bank University Enterprises Ltd., London (GB)

( * ) Notice: Subject to any disclaimer, the term of this patent is extended or adjusted under 35 U.S.C. 154(b) by 0 days.

(21) Appl. No.: 10/507,150

(22) PCT Filed: Mar. 12, 2003

(86) PCT No.: PCT/GB03/01050

§ 371 (c)(1),
(2), (4) Date: Apr. 6, 2005

(87) PCT Pub. No.: WO03/077823

PCT Pub. Date: Sep. 25, 2003

(65) Prior Publication Data

US 2005/0181918 A1 Aug. 18, 2005

(30) Foreign Application Priority Data

Mar. 12, 2002 (GB) ..... 0205760.2

(51) Int. Cl.

| | |
|---|---|
| ***A63B 21/00*** | (2006.01) |
| ***A63B 21/06*** | (2006.01) |
| ***A63B 23/00*** | (2006.01) |
| ***A61H 1/00*** | (2006.01) |

(52) U.S. Cl. ..... 482/92; 482/93; 482/148; 482/99; 601/46; 601/50; 601/51; 601/52

(58) Field of Classification Search ..... 482/92, 482/99–103; 601/46
See application file for complete search history.

(56) References Cited

U.S. PATENT DOCUMENTS

| | | | | |
|---|---|---|---|---|
| 3,205,888 | A * | 9/1965 | Stroop | 601/122 |
| 3,411,497 | A * | 11/1968 | Rickey et al. | 601/26 |
| 3,670,723 | A | 6/1972 | Simjian | |
| 3,851,874 | A * | 12/1974 | Wilkin | 482/92 |
| 5,730,687 | A * | 3/1998 | Ledany | 482/121 |
| 5,829,429 | A | 11/1998 | Hughes | |
| 5,868,653 | A * | 2/1999 | Klasen | 482/110 |
| 6,039,679 | A * | 3/2000 | Yu | 482/110 |
| 6,083,141 | A | 7/2000 | Hougen | |
| 6,217,491 | B1 * | 4/2001 | Schiessl | 482/92 |
| 6,659,918 | B2 * | 12/2003 | Schiessl | 482/92 |

FOREIGN PATENT DOCUMENTS

SU 1 447 385 A 12/1998

OTHER PUBLICATIONS

Issurin et al., "Acute and Residual Effects of Vibratory Stimulation on Explosive Strength in Elite and Amateur Athletes", Journal of Sports Sciences, 1999, v. 17, pp. 177-182.

* cited by examiner

*Primary Examiner*—Stephen R. Crow
*Assistant Examiner*—Arun Chhabra
(74) *Attorney, Agent, or Firm*—Anthony R. Barkume, P.C.

(57) ABSTRACT

An exercise apparatus in which movement of a weight by the user generates a vibration which acts on the muscles being exercised.

4 Claims, 3 Drawing Sheets

VIBRATIONARY EXERCISE APPARATUS

The present invention relates to an apparatus and method for improving the effectiveness of exercise and which can be used to improve the effectiveness of training for sportspersons and athletes and which can also be used for therapeutic purposes, such as increasing the effectiveness of exercise in improving defective muscularity and bone density etc.

Resistance training using a range of equipment such as weights, springs and other devices is a universally used method of improving the strength of men and women, including athletes and sportspersons. In order to improve the effectiveness of resistance training a wide range of modifications and adaptations have been tried.

The use of vibration applied to muscle or tendon induces a non-voluntary muscular contraction called the "tonic vibration reflex". Strength training with additional vibration has been shown to augment strength and power over and above that achieved with strength training alone. This effect is achieved through the recruitment of additional muscle fibres above the normal recruitment level. Additionally vibration is becoming a common tool used in the retardation of muscle and bone atrophy on earth and in space. Previous strength training investigations have utilized electric motor driven vibration devices that cause a non-smooth contraction of the muscles.

Current commercially available weight training devices rely either on un-modulated loads or full body vibration. These methods apply no vibrational loading at all, or fail to directly apply specific frequencies to targeted muscle groups, the latter full-body vibration systems can also quickly lead to discomfort and other negative physical side-effects.

A publication in Journal of Sport sciences 1999, 17, 177–182 discloses the effect of vibrationary stimulation on bilateral biceps curl exercises. In this publication the superimposed vibration during the exercise was transmitted to the muscles by a specially designed vibratory stimulation device. It consists of an electromotor with a speed reduction and eccentric wheel. The load is held by a cable which is passed through the eccentric wheel via the pulleys. The eccentric rotation elicited peak-to-peak oscillations of 3 mm with a frequency of 44 Hz. After vibration damping owing to cable transmission, the acceleration on the handle was about 30 $m/s^{-2}$ (RMS). Vibration from the two-arms handle was transmitted through the contracting muscles involved in the pulling action.

Such an apparatus is impractical for use by people in training under actual conditions owing to its need for an electricity supply and its size; it also requires knowledge of electronics and mechanics for use.

We have now devised an improved apparatus for enabling a vibration to be transmitted to a person exercising.

According to the invention there is provided an exercise apparatus which comprises a resistance means able to provide resistance to a movement by a user and a vibration means able to impart a vibration to the user, which vibration acts on a muscle or muscle group being exercised and in which the energy for the vibration means is provided by a movement or movements of the user.

The resistance means can be any known or conventional resistance means such as free weights, weight machines, springs, hydraulic resistance etc. It is a feature of the invention that it can be used with virtually any apparatus and can be fitted to existing equipment so as to increase its effectiveness.

When used with a weight machine, the weights are automatically returned to their starting under the action of their own weight and with free weights there can be a return spring connected to the weight by a cable.

The vibration can take place in both directions of movement i.e. when pushing and pulling on a resistance.

Preferably the user holds a grip, bar or handle and the vibration means acts on the bar, grip or handle.

Alternatively, particularly when exercising the feet, legs or back the user pushes or pulls with his feet or legs against resistance and the vibration means acts on that part of the machine in contact with the feet or legs.

With weights and weight machines the substantially linear motion generated by the movement of the exerciser lifting or moving the weights is converted to a rotational motion e.g. by a cable passing over a pulley, which cable is connected to the weights or to part of the weight machine moved by the exerciser.

The rotational motion can be made intermittent using any kind of stick/slip or intermittent braking mechanism. In one embodiment a handle pulled or pushed by an exerciser is attached to one end of a cable or belt which passes between two rollers that rotate as the cable or belt passes between them. The cable or belt connects to the weight to be lifted at its other end. One of the rollers has pads or areas of raised rubber equally spaced around the wheel (resembling a cog). These rubber pads exert a greater resistance to the cable as is rotates and comes into contact with the other roller. This has a braking action on the cable or belt until it is clear of the pad. The frequency of this brake depends upon the rotational speed and on the distance of separation between consecutive rubber "brakes" on the wheel. The device can be used equally well on existing machines or on free weights (bar and dumbbells). For use with free weights, one end of a cable or belt is attached to the bar or dumbbell and passes through the vibration device. The other end of the cable or belt is attached to a spring and the spring is fixed e.g. to the floor. The subject lifts the weight, drawing the belt or cable through the vibration device and, upon relaxation, the cable is drawn back through the vibration device by the spring to its starting position.

In another embodiment of the invention the vibration means can be operated by connecting a moving part of the apparatus to a means for converting linear motion to an intermittent rotational motion. With a machine which the uses hands, feet or other part of the anatomy to move a bar or pad which is connected to a weight or other resistance by a cable or belt, this cable or belt normally passes over a pulley and connects with the weights; this pulley can be connected to a means for providing the vibration. For example there can be a ratchet wheel and a spring loaded ratchet attached to the pulley so that, as the ratchet wheel rotates, the ratchet mechanism causes the pulley to rotate in jerks as in conventional ratchets and this causes a vibration to be transmitted to the user.

Alternatively a further pulley wheel can be incorporated with a cable passing over this pulley wheel and thus imparting a rotational motion to this pulley wheel and this rotational motion can be converted to a vibration as described above.

The cable or belt will transmit the vibrationary motion directly to the user so that it automatically goes to those muscle groups being exercised.

In a further embodiment of the invention utilises the application of modulation to a damping system connected between static and moving components of a weight training or exercise device, providing a rapidly changing force which is transmitted into the working bodily muscle group. The vibration frequency may be pre-set by design or adjustable to suit different working muscles to achieve an optimal response.

The damping is effected on a flow of fluid through a damping means and the flow of fluid is operated by a pumping means connected to a moving part of the equipment e.g. a piston and cylinder arrangement or by a rotary pump or by any other means. The damping system can comprise a fluid passing through a control valve so that, by intermittently varying the flow of fluid through the control valve, a vibration can be set up. For example the control valve can turn the flow of fluid on and off at a desired frequency, the control valve settings can be varied so a frequency within a wide range can be chosen.

As the aperture of pneumatic/hydraulic control valves may be hard to control, a variable on-off duty cycle or mark to space ratio may be used to control the relative on-off period of the valve whilst maintaining the repeat frequency of the produced vibration, thus producing a variable resistance over time proportional to the ratio of time over which the valve is closed.

The fluid can be a gas e.g. air or a liquid e.g. a hydraulic liquid. When the fluid is a hydraulic liquid the control valve and pumping means form part of a closed hydraulic circuit.

The control valve can comprise a switchable valve system allowing single or double action damping controlled by simple manual or mechanical means, or under electronic hardware or programmable software control.

In this particular embodiment working load weights may be substituted for by use of a pneumatic or hydraulic damping system alone as in a hydraulic resistance system of the type sold commercially.

The frequency of vibration is preferably adjusted so that it is at the optimum frequency for the muscle groups being exercised. Preferably the means for generating vibrations can generate vibrations of variable frequency and variable amplitude. Typical frequencies of vibration are from 5 to 100 Hz e.g. 10 to 50 Hz.

The invention can be retrofitted to existing weight machines by attaching a means for generating vibrations to a moving part of the machine connected to a part moved by the user so that the vibration generated is transferred to the muscle groups being exercised.

As well as assisting in the development of improved muscularity in sportsmen and women, athletes etc. the invention can also be used for increasing the muscular strength of people who suffer from illness or weakness due to an incapacity and for helping people who suffer or are recovering form an illness or other incapacity.

It is a feature of this embodiment that, compared with existing methods, it enables a reduced weight load to be used with no loss of effectiveness.

In another embodiment of the invention an apparatus is provided to develop the muscular groups involved in breathing and in improving breath control.

In this embodiment of the invention there is provided an apparatus which comprises a breathing means through which a user can breathe and an air flow interruption means connected to the breathing means, which interruption means is adapted to cause a periodic interruption to air flowing through the interruption means to the breathing means.

The breathing means can comprise a mouthpiece which can fit over the mouth and/or nose of a user so that a user breathes through the mouthpiece. This mouthpiece is preferably connected to the interruption means e.g. by a conduit, or is directly attached to the interruption means.

The interruption means preferably produces regular periodic interruptions to the flow of air reaching the mouthpiece and being breathed by a user. The interruption can be caused by a valve mechanism, such as a reed or other oscillating valve system, with the air passing through valve mechanism being regularly interrupted. Alternatively there can be a mechanically or electrically controlled valve mechanism which regularly and periodically interrupts the flow of air.

The frequency of the interruptions to the flow of air is preferably in the range of 5 to 100 Hz e.g. 10 to 50 Hz typically 30 Hz. This means that the flow of air through the interruption means is interrupted at this frequency.

An embodiment of a mechanical interruption means comprises two discs, at least one of which can be rotated relative to the other, with each of the discs having at least one hole in it; the discs being positioned in the air flow so that, as at least one of the discs rotates relative to the other disc, the holes in the two discs are periodically coincident so as to form a continuous air flow passage.

This embodiment will strengthen and develop the muscles associated with breathing and, as well as assisting in the development of breath capacity in athletes, singers etc. it can be used to help develop increased breathing capacity in people who have reduced or defective capacity.

The invention is illustrated in the accompanying drawings in which

Figure 1:
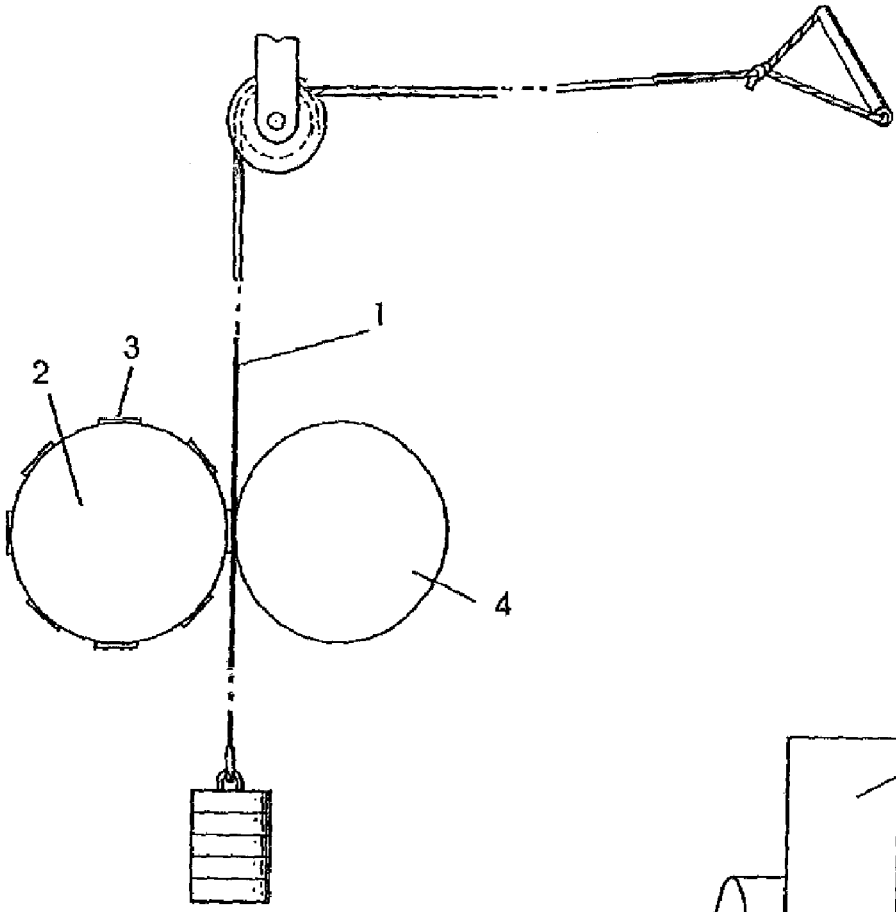
FIG. 1 is a side view of an embodiment of the invention attached to an exercise machine
Figure 2:
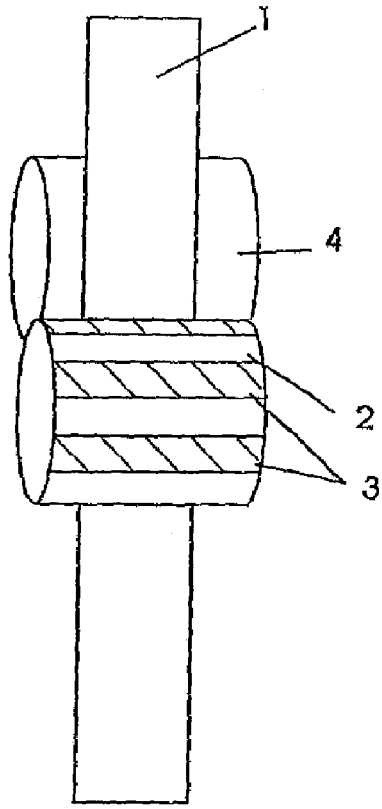
FIG. 2 is a front view of FIG. 1

Referring to FIGS. 1 and 2 a belt (1) is connected at one end to the weights lifted by the user and the other end is attached to the hand grips moved by the user. A roller (2) has rubber pads (3) positioned around its circumference. Roller (4) is positioned so that the band (1) is gripped between rollers (2) and (4). In use, as the user pulls on the weights, the band moves and causes the rollers (2) and (4) to rotate. As the band passes over the pads (3) a vibration is given to the band which vibration is passed onto the user via the hand grips. This vibration acts on the muscles being exercised and the frequency of vibration can be controlled by the number of pads (3).

Figure 3:
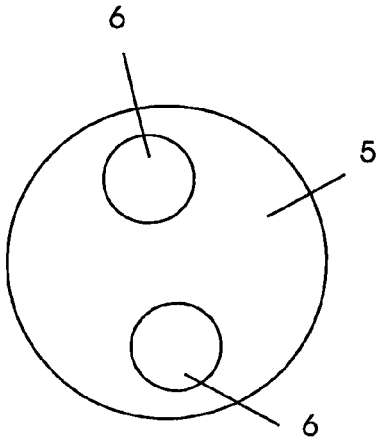
FIG. 3 is one disc used in a different embodiment of the invention
Figure 4:
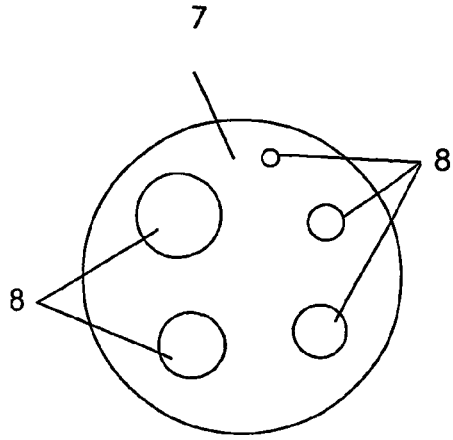
FIG. 4 is a second disc
Figure 5:
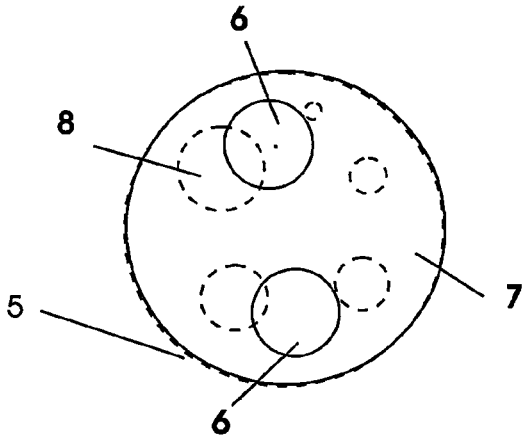
FIG. 5 shows the discs of FIGS. 2 and 3 in position

Referring to FIGS. 3, 4 and 5 a first disc (5) has two holes (6) in it and a second disc (7) has holes (8) of varying size in it. The two discs are located on a common axis and the disc (5) is connected to a motor. As the disc (5) is rotated by the motor, the holes (8) are periodically coincident with the holes (6).

Figure 6:
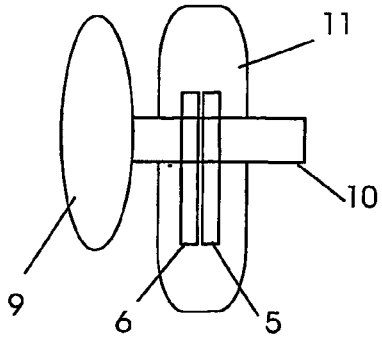
FIG. 6 shows a breathing apparatus using the invention.

Referring to FIG. 6, the discs are mounted in a chamber (1) with an air conduit (10) passing through it with one end connected to mouthpiece (9). The air conduit is positioned so that it connects to a hole (8) and so, as one of the holes (6) is coincident with the hole (8) a continuous air passage is formed and, as the hole (6) moves out of coincidence, there is an interruption to the air supply and this periodic interruption causes a vibration effect in the breathing muscles of the user. The rate of flow of the air to the user can be controlled by the size of the hole (8) used and the frequency of vibration controlled by the speed of rotation of the disc (5).

Figure 7:
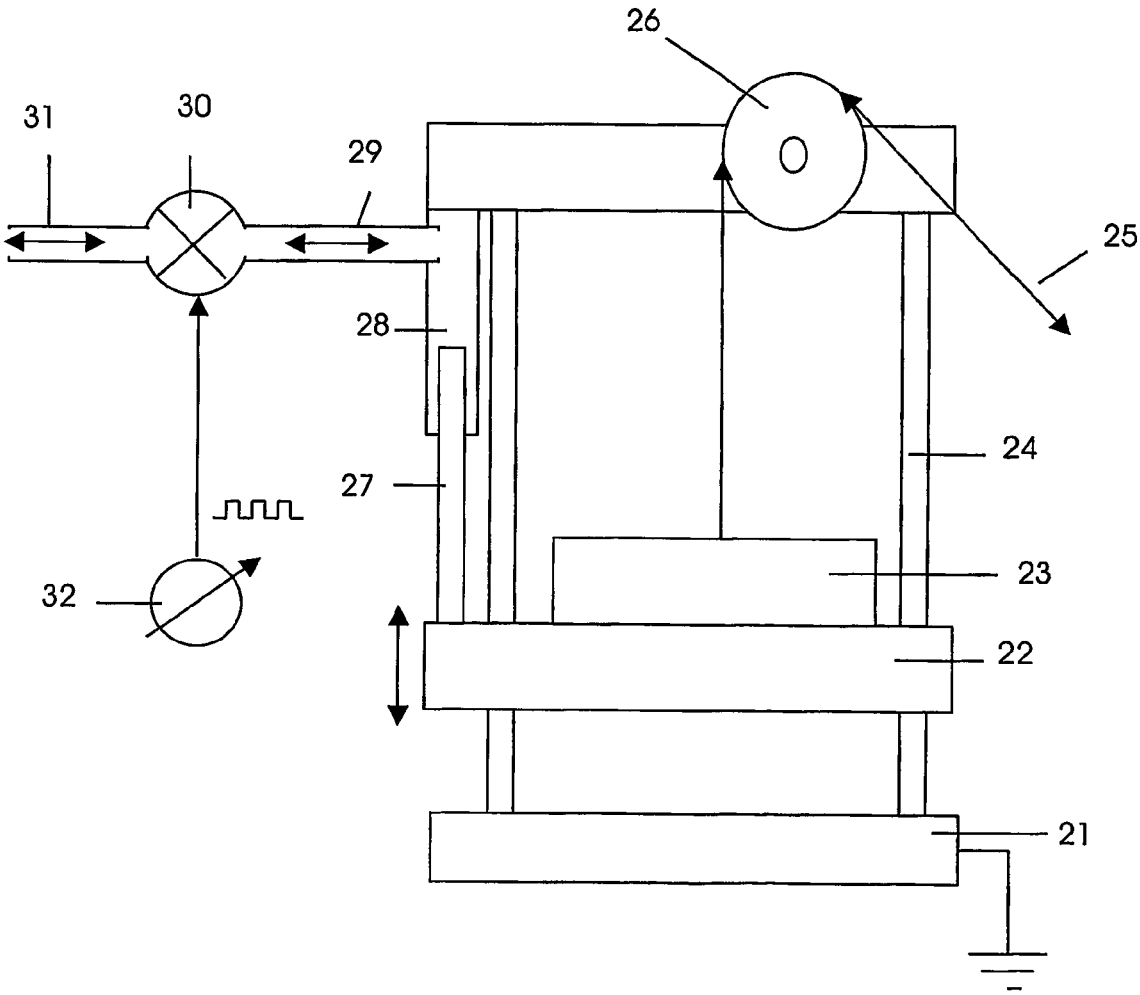
FIG. 7 shows a hydraulic damping system applied to a weight machine

Referring to FIG. 7 a weight lifting machine comprises a fixed framework (21), a sliding member (22) and attached adjustable weight (23) which may slide up and down guide rails (24) when a person pulls on cable (25) which is guided over pulley (26), being connected to the sliding member (22) and weight (23). The sliding member (22) is attached to a piston (27) which is located in a cylinder (28).

When cable (25) is pulled, the sliding member (22) with attached weight (23) is moved upwards against gravity providing a working load to the user's muscles, the piston (27) displacing air in cylinder (28) out through port (29). The air displacement is checked by a control valve (30) which is driven on and off at the desired frequency by a controller (32), causing the air flow to be intermittently interrupted before release to atmosphere via port (31). The switched air-flow checking action of control valve (30) provides a time variant damping load over and above that provided by the lifted weight (33), translating vibration into the operator's muscles employed in the lifting action.

The invention claimed is:

1. An exercise apparatus which comprises (i) a resistance means able to provide resistance to a movement by a user and (ii) a vibration means able to impart a vibration to the user, which vibration means acts on a muscle or muscle group being exercised and in which the energy for the vibration means is provided by a movement or movements of the user, wherein the vibration means comprises a cable or belt and two rollers that are rotated by movement of the cable or belt as it passes therebetween, the cable or belt being connected to the resistance means; and wherein one of the rollers has areas of raised rubber equally spaced around its circumference so that these areas exert a greater resistance to the cable or belt as this roller rotates and comes into contact with the other roller; and wherein there is a handle or grip attached to the cable or belt.

2. An exercise apparatus according to claim 1 in which the resistance means is selected from free weights, a weight machine, a spring resistance and a hydraulic resistance.

3. An exercise apparatus according to claim 1, in which, in use, the frequencies of vibration are from 5 to 100 Hz.

4. An exercise apparatus according to claim 1 in which the frequencies of vibration are from 5 to 100 Hz.

* * * * *